US011618666B2

(12) United States Patent
Cahill et al.

(10) Patent No.: US 11,618,666 B2
(45) Date of Patent: Apr. 4, 2023

(54) CONTACTLESS LIQUID DISPENSING VALVE

(71) Applicant: Deltrol Corp., Milwaukee, WI (US)

(72) Inventors: Brian Cahill, Oak Creek, WI (US); Nick Buettner, Burlington, WI (US); James Ostrenga, Milwaukee, WI (US)

(73) Assignee: Deltrol Corp., Milwaukee, WI (US)

( * ) Notice: Subject to any disclaimer, the term of this patent is extended or adjusted under 35 U.S.C. 154(b) by 365 days.

(21) Appl. No.: 16/929,283

(22) Filed: Jul. 15, 2020

(65) Prior Publication Data

US 2022/0017354 A1 Jan. 20, 2022

(51) Int. Cl.

| | |
|---|---|
| ***B67D 3/00*** | (2006.01) |
| ***B67D 3/02*** | (2006.01) |
| ***E03C 1/05*** | (2006.01) |

(52) U.S. Cl.

CPC ..... *B67D 3/02* (2013.01); *B67D 3/0003* (2013.01); *E03C 1/057* (2013.01); *B67D 2210/00141* (2013.01)

(58) Field of Classification Search

CPC .... B67D 1/0888; B67D 1/277; B67D 3/0003; E03C 1/057

See application file for complete search history.

(56) References Cited

U.S. PATENT DOCUMENTS

| | | | |
|---|---|---|---|
| 5,566,702 | A | 10/1996 | Philipp |
| 5,862,844 | A | 1/1999 | Perrin |
| 5,868,311 | A | 2/1999 | Cretu-Petra |
| 6,688,134 | B2 | 2/2004 | Barton et al. |
| 6,705,356 | B2 | 3/2004 | Barton et al. |
| 7,204,519 | B2 | 4/2007 | Kubo et al. |
| 7,765,916 | B2 | 8/2010 | Ophardt et al. |
| 8,006,712 | B2 | 8/2011 | Boey |

(Continued)

FOREIGN PATENT DOCUMENTS

| | | | |
|---|---|---|---|
| WO | 03042612 | A2 | 5/2003 |
| WO | 2019113669 | A1 | 6/2019 |
| WO | WO-2021240483 | A1 * | 12/2021 |

OTHER PUBLICATIONS

Extended European Search Report for corresponding European Application No. 20193485 dated Feb. 16, 2021.

(Continued)

*Primary Examiner* — Benjamin R Shaw
*Assistant Examiner* — Randall A Gruby
(74) *Attorney, Agent, or Firm* — Andrus Intellectual Property Law, LLP

(57) ABSTRACT

A contactless valve configured to dispense a liquid can include an actuator configured to move a plug between a closed position in which the plug prevents the flow of liquid through valve body, and an open position in which liquid can be dispensed through an outlet. The valve can include an activation sensor, a presence sensor, and a controller configured to control the actuator and in electrical communication with the activation sensor and the presence sensor. The controller can be configured to switch the presence sensor into the activated state in response to the detection of the prerequisite condition by the activation sensor, and to control the actuator to move the plug from the closed position to the open position in response to the detection of the object in the upper detection zone by the presence sensor.

20 Claims, 6 Drawing Sheets

(56) References Cited

U.S. PATENT DOCUMENTS

| | | | | |
|---|---|---|---|---|
| 8,167,004 | B2 | 5/2012 | Lee et al. | |
| 8,572,772 | B2 | 11/2013 | Wolf et al. | |
| 9,724,443 | B2 * | 8/2017 | Smith | A61L 2/0088 |
| 10,072,403 | B2 | 9/2018 | Shirai et al. | |
| 10,450,732 | B2 | 10/2019 | Xia | |
| 11,274,028 | B2 * | 3/2022 | Defazio | B67D 1/0884 |
| 2013/0264355 | A1 | 10/2013 | Jodoin | |
| 2016/0068383 | A1 | 3/2016 | Falco, III | |
| 2016/0340879 | A1 | 11/2016 | Chen | |
| 2017/0101766 | A1 | 4/2017 | Blizzard et al. | |
| 2019/0003163 | A1 | 1/2019 | Loeck et al. | |
| 2020/0307983 | A1 | 10/2020 | Checchinato | |
| 2022/0112069 | A1 * | 4/2022 | Abrego | B67D 1/0888 |

OTHER PUBLICATIONS

Water Saver Products, LLC. "FaucetMinder Automatic Hands Free Touchless Faucet Sensor" Instruction Manual. 2019.

* cited by examiner

CONTACTLESS LIQUID DISPENSING VALVE

FIELD

The present disclosure relates to dispensers configured to dispense a liquid, and in particular, a touchless liquid dispensing valve.

BACKGROUND

Various types of dispensing systems or dispensing appliances are utilized for dispensing a predetermined material into a receiving member. Traditional commercial and domestic dispensing systems have utilized a mechanically actuated switch to initiate and inhibit the dispensing of the predetermined material into the receiving member. For example, many liquid dispensing systems include a button, switch or lever which is actuated by a user's hand, which may necessitate continuous contact of the dispensing actuator, through touch, to control the dispensing process.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

Embodiments of a contactless valve can be configured to dispense a liquid from a fluid source. The contactless valve can include a housing secured to a valve body, which may define a flow path from an inlet to an outlet. An actuator can be mounted in the housing and may be configured to move a plug between a closed position in which the plug prevents the flow of liquid through the valve body, and an open position in which the flow of liquid along the flow path is permitted. An activation sensor can be positioned within the housing and may be configured to detect a prerequisite condition. A presence sensor can be positioned within the housing and may be configured to detect the presence of an object in an upper detection zone when the presence sensor is in an activated state. A controller can be configured to control the actuator and can be in electrical communication with the activation sensor and the presence sensor. The controller can be configured to switch the presence sensor into the activated state in response to the detection of the prerequisite condition by the activation sensor, and to control the actuator to move the plug from the closed position to the open position in response to the detection of the object in the upper detection zone by the presence sensor.

In some embodiments, the presence sensor can be a hand sensor configured to detect the presence of a hand in the upper detection zone. Additionally or alternatively, the activation sensor may be a temperature sensor configured to detect the temperature of the liquid to be dispensed, and the prerequisite condition can be a liquid temperature that is within a temperature range.

In some embodiments, an activation sensor may be a motion sensor configured to detect movement in a lower detection zone extending outlet, and the prerequisite condition can be detection of movement in the lower detection zone. In such an embodiment, the presence sensor can be a cup sensor configured to detect the presence of a beverage vessel in the lower detection zone. The cup sensor may be configured to differentiate between beverage vessels and other objects, and the prerequisite condition can be movement of the beverage vessel in the lower detection zone.

In some embodiments, the inlet can include a mounting interface configured to secure the contactless valve to the fluid source. Additionally or alternatively, a display can be positioned on a front side of the housing and in electrical communication with the controller, and the display may be configured to provide status indications.

In some embodiments, the contactless valve may include a power source removably received in a battery compartment within the housing. In such an embodiment, a lid can be configured to seal an opening into the battery compartment when the lid is secured to the housing, and a latch may be configured to secure the lid to the housing, wherein the latch can be unlocked to remove the lid by hand.

Embodiments of a method for dispensing a liquid can be used with a contactless valve. The valve can include a valve body defining a flow path from an inlet to an outlet and a plug selectively movable between a closed position in which flow through the valve body is restricted, and an open position in which flow through the valve body is permitted. The method can include steps for detecting, with an activation sensor, a prerequisite condition, activating, with a controller, a presence sensor in response to detection of the prerequisite condition by the activation sensor, detecting, with the presence sensor, the presence of an object in an upper detection zone, and moving, with an actuator, the plug from the closed position to the open position in response to detecting the presence of an object in an upper detection zone, thereby dispensing liquid from the outlet.

In some embodiments, the presence sensor can be a hand sensor and the step of detecting an object in the upper detection zone may include detecting, with the hand sensor, the presence of a hand in the upper detection zone. Additionally or alternatively, the method may include steps for deactivating, with the controller, the presence sensor if the object is not detected in the upper detection zone within a search time limit.

In some embodiments, the activation sensor can be a temperature sensor, and the step of detecting the prerequisite condition may include detecting, with the temperature sensor, a temperature of the liquid to be dispensed that is within a temperature range.

In some embodiments, the activation sensor can be a motion sensor, and the step of detecting the prerequisite condition may include detecting, with the motion sensor, movement within a lower detection zone. In such an embodiment. The motion sensor can be a cup sensor, and the step of detecting the prerequisite condition may include detecting, with the cup sensor, movement of a beverage vessel in the lower detection zone.

In some embodiments, the method can include steps for monitoring, with the presence sensor, the object in the upper detection zone while the liquid is dispensed, and moving, with the actuator, the plug from the open position to the closed position in response to the object moving out of the upper detection zone. In such an embodiment, the method may further include steps for continuing to monitor the presence sensor after moving the plug to the closed position, and moving the plug back into the open position in response to the object moving back into the upper detection zone, or deactivating the presence sensor after a dwell time limit has been reached.

In some embodiments, the method can include steps for moving, with the actuator, the plug from the open position to the closed position after a dispense time limit has been reached, and deactivating the presence sensor after moving the plug to the closed position. Additionally or alternatively, some embodiments can include steps for illuminating an indicator light on a display in response to the detection of the prerequisite condition by the activation sensor.

Various other features, objects, and advantages will be made apparent from the following description taken together with the drawings.

BRIEF DESCRIPTION OF THE DRAWINGS

The present disclosure is described with reference to the following Figures. Where possible, like numbers are used throughout the Figures to reference like features and like components.

DETAILED DISCLOSURE

Figure 1:
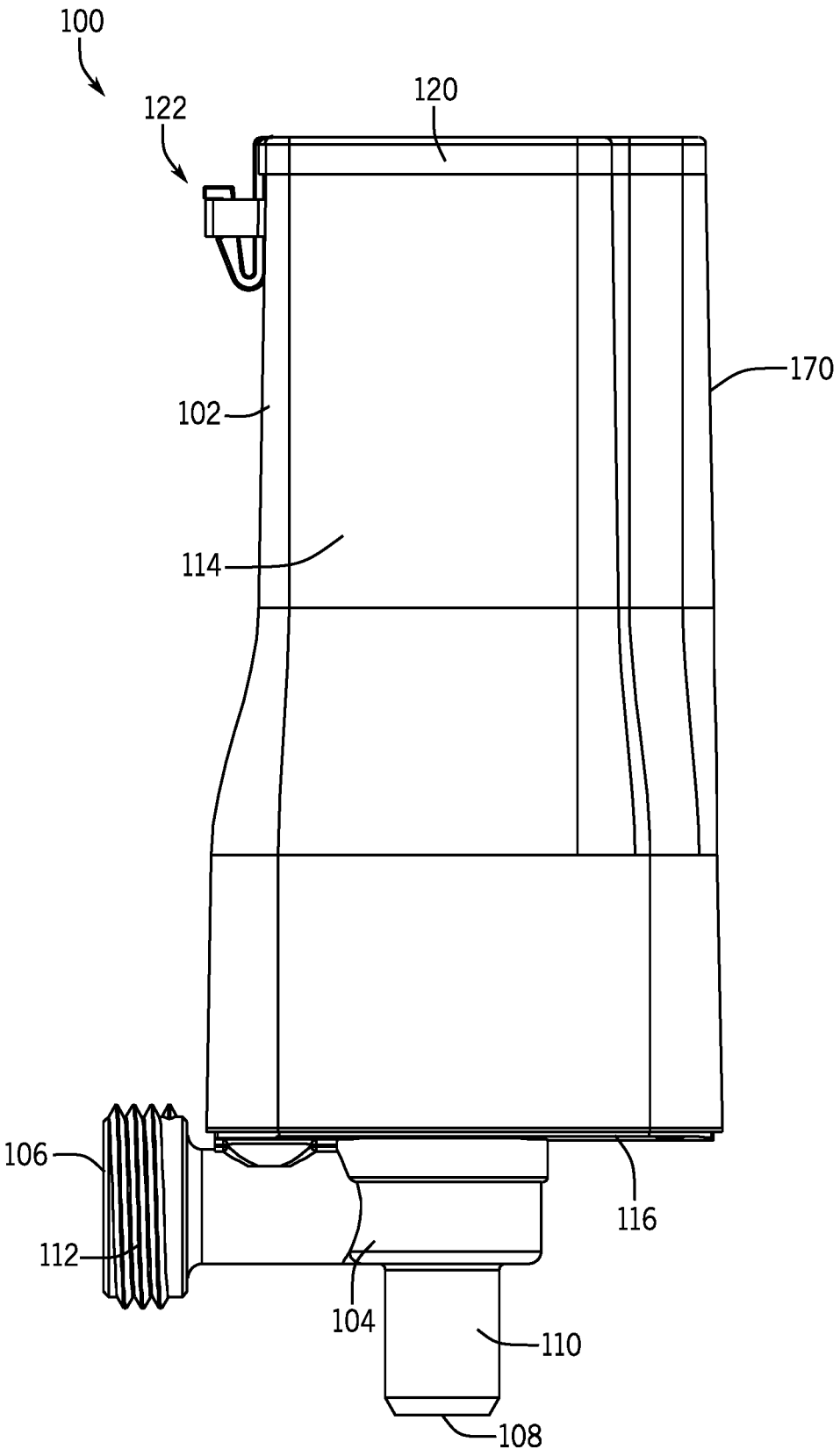
FIG. 1 is a side view of an embodiment of a contactless valve.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C Likewise, unless otherwise specified or limited, the terms "mounted," "connected," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "front," or "back" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements or machines from another.

Embodiments of a contactless valve can be configured for use with existing fluid sources in place of traditional physically operated flow valves. The valve can include an inlet with a mounting interface configured to secure the contactless valve to at least one of a coffee urn, a hot water dispenser, a water cooler, a beverage tap, a faucet, and any other type of liquid source or liquid container (see, e.g., FIG. 5). The contactless valve can include a standardized mounting interface that may make the contactless valve interchangeable with existing liquid dispensing valves.

Some embodiments of a contactless valve can include a plurality of sensors configured to control the dispensing of a liquid through the valve. A hand sensor can be configured to detect a user's hand when held over the valve, and a controller can control the valve to dispense liquid when the hand is detected. To avoid incidental opening of the valve, the controller can be configured to only activate the hand sensor to search for a user's hand after an activation sensor has detected a prerequisite condition for dispensing fluid. Some embodiments can include an activation sensor configured as a cup sensor configured to detect the presence of a cup 85 (or other beverage vessel) below the outlet of the valve. Additionally or alternatively, an embodiment of a contactless valve can include an activation sensor configured as a temperature sensor configured to detect a temperature of the liquid to be dispensed.

Referring now to FIGS. 1-5, embodiments of a contactless dispensing valve 100 can include a housing 102 mounted on a valve body 104 that defines a flow path from an inlet 106 to an outlet 108 at the end of a downward facing nozzle 110. The inlet 106 is configured to be secured to a fluid source 80, which can provide a supply of liquid to the valve body 104 through the inlet 106. For example, threads 112 can be formed around the circumference of the outlet 108 and can be configured to engage corresponding threads on the fluid source. In some embodiments, the threads 112 at the inlet 106 can be standardized to match the thread configurations of existing manual valves. This may be useful, for example, for retrofitting existing fluid dispensers to convert them into touch free dispensers by using the contactless valve 100 in place of a traditional manually actuated valve.

In the illustrated embodiments, the housing 102 is positioned on a top side of the valve body 104. Side walls 114 of the housing 102 extend upward from a bottom wall 116, which is formed integrally with the valve body 104, to an opening 118 at the top of the housing 102. A lid 120 is removably securable to the side walls 114, and is configured to seal the housing 102 when secured thereto. A latching feature, for example the illustrated snap-fit latch 122, can be positioned on the side wall 114 and can be configured to retain the lid 120 on the side walls 114 and hold the lid 120 in a closed position. The snap-fit latch 122 includes a deformable cantilever, which may be formed on the lid 120 or the side walls 114, configured to engage a slot formed on the other one of the lid 120 and the side walls 114. The cantilever can be configured to be deformable by hand so that the snap-fit latch 122 can be unlocked to remove the lid 120 without the use of tools.

Embodiments of a housing can be configured to hold a variety of electrical components that may be useful for operating a contactless valve. In the illustrated embodiments, for example, the housing 102 can be configured to hold at least one of a power source 126, and actuator 128 configured to selectively allow flow through the valve body 104, a plurality of sensors, and a controller 132 configured to be in electrical communication with the sensor and to control the actuator 128.

Figure 3:
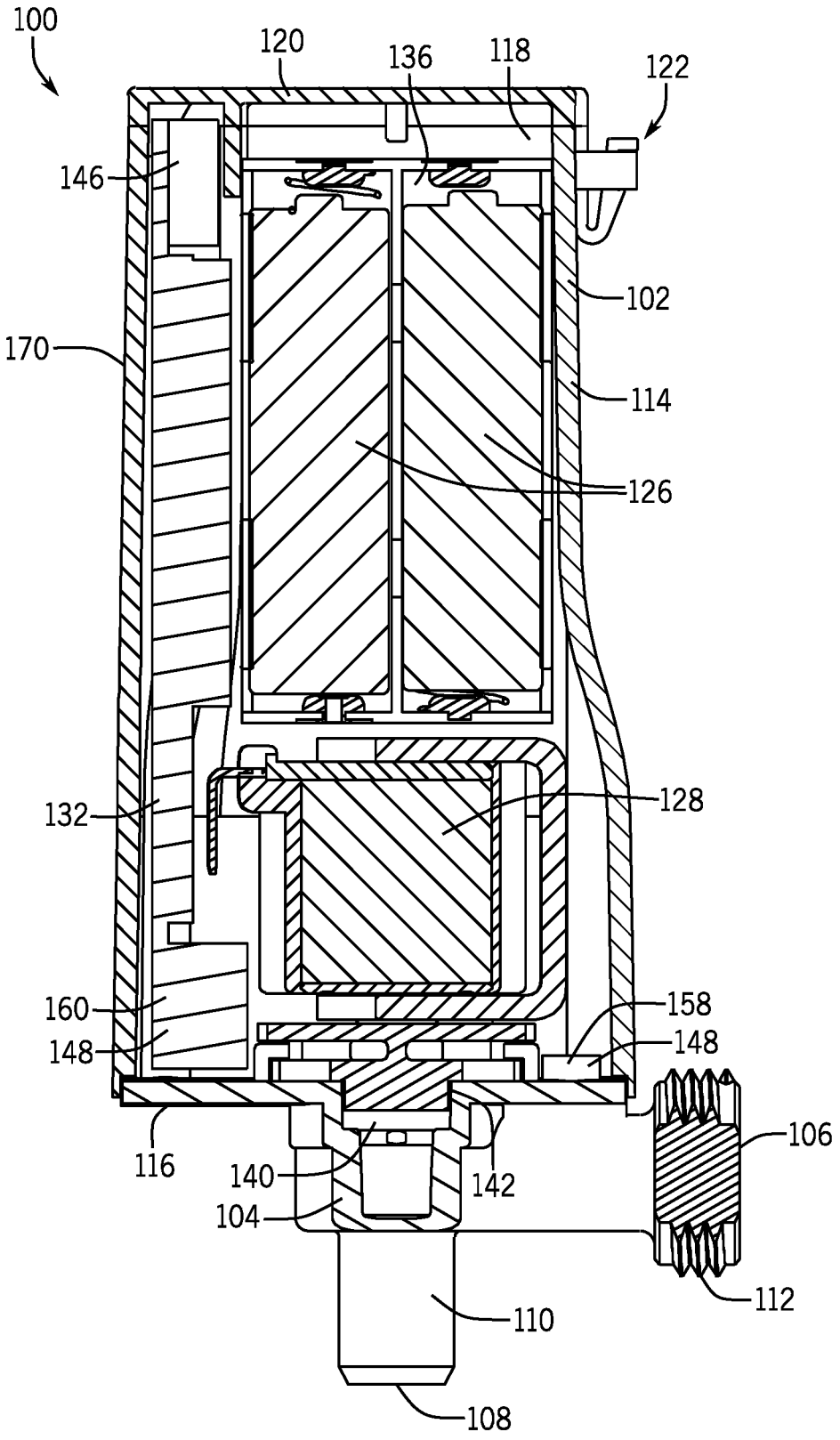
FIG. 3 is a cross-sectional side view of the contactless valve of FIG. 2 taken along section line 3-3.

Referring to FIG. 3, the power source 126 can be configured as a removable power source 126 received within a battery compartment 136 of the housing 102. The battery compartment 136 can be accessed through the opening 118 into the housing 102 while the lid 120 is removed. This may be useful, for example, to allow a depleted power source to be replaced without the use of any tools. The internal power source 126 may additionally be useful in order to enable the contactless valve 100 to be used with a variety of existing liquid sources without implementing other changes to the liquid source. In the illustrated embodiments, the power source 126 is configured as a plurality of AA size batteries received within the battery compartment 136. Some embodiments can include a different number of batteries, and at least one of the batteries may be smaller or larger than at least one other battery. In some embodiments, a power source can be configured as a single removable battery. Further still, some embodiments of a contactless valve can include a fixed power source configured to be rechargeable with an external power supply, and some embodiments can be powered by a wired connection to an external power supply.

As previously mentioned, the flow of liquid from the inlet 106 to the outlet 108 can be controlled by an actuator 128 positioned within the housing 102. The actuator 128 can be mounted on the bottom wall 116 and can include a plug member 140 that extends through an opening 142 into the flow path through the valve body 104. The actuator 128 is configured to move the plug member 130 within the valve body 103 between a closed position and an open position. In the closed position, the plug member 130 is configured to seal the flow path, thereby preventing liquid from flowing from the inlet 106 to the outlet. When moved in the open position, the plug member 130 no longer seals the flow path and liquid is allowed to flow from the inlet 106 to the outlet 108.

In some embodiments, a contactless valve can include a controller configured to control the actuator to move between the open and closed positions based on data communicated to the controller by a plurality of sensors. In the illustrated embodiments, for example, the contactless valve 100 can include a controller 132 positioned within the housing 102 and control and communicate data with a presence sensor 146, and at least one activation sensor 148.

The presence sensor 146 can be mounted in the housing 102 proximate a top side thereof, and can be configured to detect the presence of an object within an upper detection zone 152 that extending above the housing 102. Embodiments of a presence sensor 146 can be configured to detect a plurality of different objects within the upper detection zone 152. In the illustrated embodiments, for example, the presence sensor 146 can be a hand sensor configured to detect the presence of a user's hand (not shown). This may be useful to allow a user to interact with the valve 100 without physically touching any controls.

Figure 4:
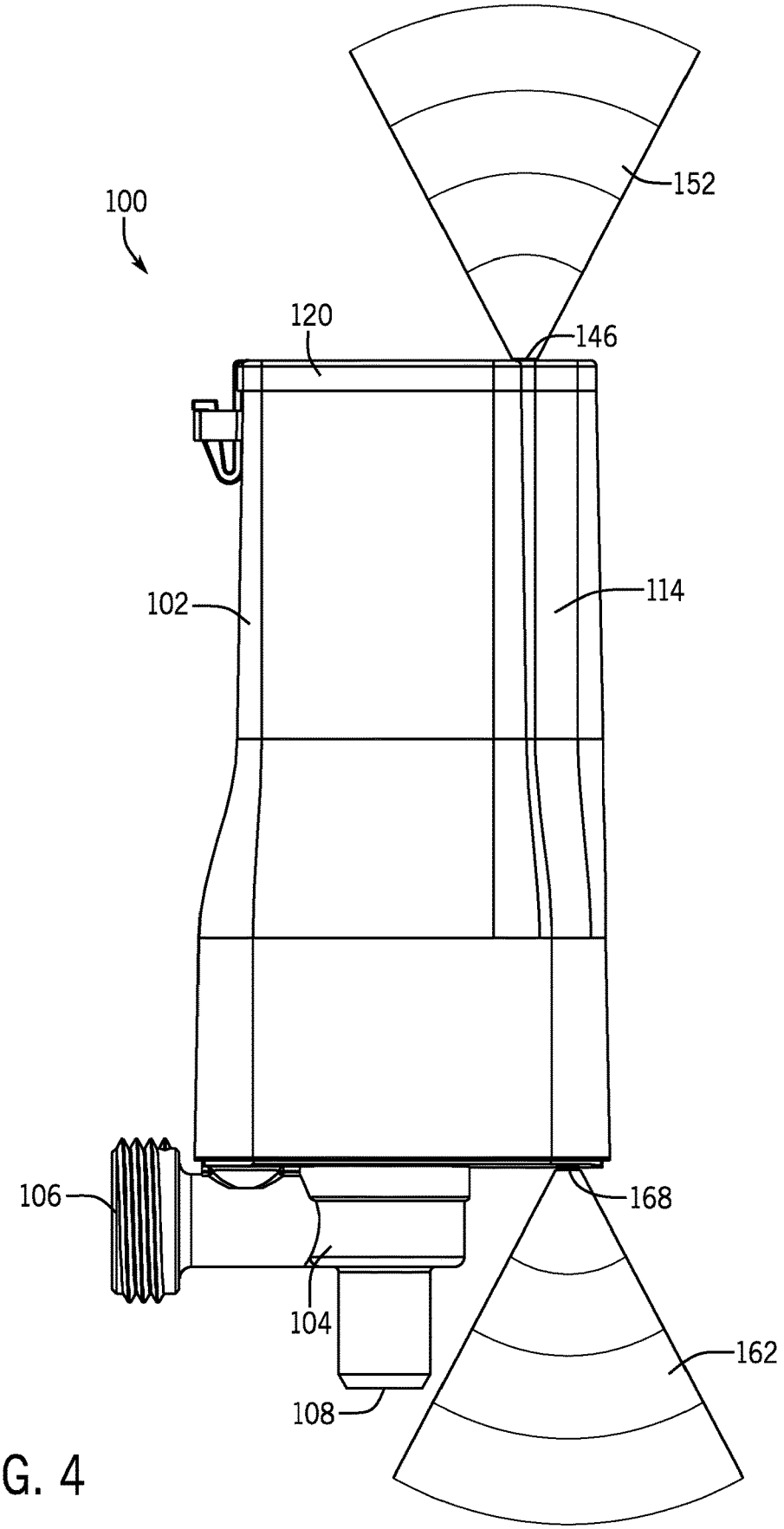
FIG. 4 is a side view of the contactless valve of FIG. 3 with upper and lower detection zones.

As illustrated in FIG. 4, the upper detection zone 152 is generally cone-shaped and projects outward from the presence sensor 146. The size and shape of the upper detection zone 152 can be selected based on at least of the environment of the valve, the object intended to be detected, the type of sensor being implemented, and any other factor. For example, some embodiments can include a presence sensor 146 configured to detect an object in an upper detection zone 152 that forms a four inch radius around the presence sensor 146 and that extends four inches upwards from the presence sensor 146. Some embodiments can have an upper detection zone that is smaller and/or larger in at least one dimension. Additionally or alternatively, an upper detection zone may extend outward from the housing at an angle, and an upper detection zone may have at least a portion that extends past a front side and/or a lateral side of the housing.

In some embodiments, the presence sensor 146 can be configured to be switched between an activated state and an idle state by the controller 132. When in an activated state, the presence sensor 146 can actively scan for an object in the upper detection zone 152. When an object is detected in the upper detection zone 152, the presence sensor 146 can communicate to the controller 132 that an object has been detected via a control signal. When the presence sensor 146 is switched into an idle state, the controller 132 may deactivate or power off the presence sensor 146 so that it is not actively scanning for an object in the upper detection zone 152. This may be useful, for example, in order to reduce power consumption when the contactless valve 100 is not in use. Come embodiments can be configured so that the presence sensor 146 remains active and continues to scan for object while in the idle state, but does not communicate a control signal to the controller 132 if an object is detected in the upper detection zone 152. In some embodiments, the presence sensor 146 can be configured to continue to scanning for an object in the upper detection zone 152 and to still communicate a control signal to the controller 132 while in an idle state, but the controller 150 will ignore or take no action based on the received control signal. In embodiments in which the contactless valve 100 is secured to a liquid container 80 (see, e.g., FIG. 5), the presence sensor 146 and/or the controller 132 may be configured to ignore a detection of the liquid container 80 if a portion of the liquid container falls within the upper detection zone 152.

In some embodiments, a controller can be configured to switch the presence sensor between the activated state and the idle state based on, amongst other things, control signals communicated to the to the controller by at least one activation sensor upon detection of a preliminary condition for dispensing liquid. As illustrated in FIG. 3, for example, embodiments of a contactless valve 100 can include an activation sensor 148 that is a temperature sensor 158 configured to sense the temperature of the liquid to be dispensed by the valve 100. Additionally or alternatively, embodiments of a contactless valve 100 can include an activation sensor 148 that is a motion sensor 160 configured to detect motion of an object in a lower detection zone 162 (see, e.g., FIG. 4). Embodiments of a contactless valve can be configured to interchangeably use either a temperature sensor or a motion sensor as an activation sensor, or to include both a temperature sensor and a motion sensor. Further, some embodiments can be configured to include at least one additional type of sensor in addition or as an alternative to a temperature sensor and/or a motion sensor.

In embodiments of a contactless valve 100 including a temperature sensor 158 configured as an activation sensor, the temperature sensor 158 can be positioned in at least one of the housing 102, the valve body 104, an opening extending between the housing 102 and the valve body 104, in contact with the inlet 106, and any other position on the valve 100. The temperature sensor 154 can be configured to measure the temperature of liquid in the valve body 104 between the inlet 106 and the plug member 130, and to communicate the measured temperature to the controller 132 via a control signal. The controller 132 can then compare the measured temperature to a temperature limit to confirm that the liquid is within a temperature limit range, thereby satisfying the prerequisite condition. For example, embodiments of a controller 132 can be configured to verify that the temperature of the liquid is at least one of above a minimum temperature threshold, below a maximum temperature threshold, and within a desired range of temperatures. The temperature limit range may be programmable by a user, or the temperature limit range may be a predetermined value or values. For example, a temperature sensor 158 can be configured as an activation sensor, and the prerequisite condition may be the detection of a liquid temperature that is below a maximum temperature limit of forty degrees Celsius. This may be useful to prevent a contactless valve configured for use with cold liquids from dispensing a hot liquid. Some embodiments can be configured with additional or alternative temperature requirements for the prerequisite condition, and the prerequisite condition can be based on the intended use of the contactless valve and/or any other factor.

Embodiments of a temperature sensor can be configured as at least one of a thermistor, a thermocouple, and any other type of temperature sensing device. Some embodiments can include a temperature sensor configured to measure the temperature of the liquid to be dispensed at a different location in addition or as an alternative to measurement between the inlet and the stop member. For example, a temperature sensor can be positioned outside of the housing (e.g., in or on a container holding the liquid to be dispensed) and can be configured to communicate with the controller through a wired or wireless connection. Additionally or alternatively, a temperature sensor can be configured to only communicate a control signal to the controller when the temperature is within the desired temperature limit range (when the prerequisite condition is detected), or when the temperature is outside of the desired temperature limit (when the prerequisite condition is not detected).

In embodiments of a contactless valve 100 including a motion sensor 160 configured as an activation sensor, the motion sensor 160 can be mounted within the housing proximate the bottom wall 116 or secured to the lid 120. The motion sensor 160 can be configured to detect movement of an object through a lower detection zone 162 extending below the housing 102. When movement is detected in the lower detection zone 162, the motion sensor 160 can communicate a control signal to the controller 132.

As illustrated in FIG. 4, the lower detection zone 162 is generally cone-shaped and projects downward from the motion sensor 160 such that at least a portion of the lower detection zone 162 is positioned below the outlet 108. The size and shape of the lower detection zone 162 can be selected based on at least of the environment of the valve, the object intended to be detected, the type of sensor being implemented, and any other factor. For example, some embodiments can include motion sensor 160 with a lower detection zone 162 that forms a four inch radius around outlet 108 and that extends four inches downward from the bottom of the outlet 108. Some embodiments can have a lower detection zone that is smaller and/or larger in at least one dimension. Additionally or alternatively, a lower detection zone may extend outward from the housing at an angle, and a lower detection zone may have at least a portion that extends past a front side and/or a lateral side of the housing.

Figure 5:
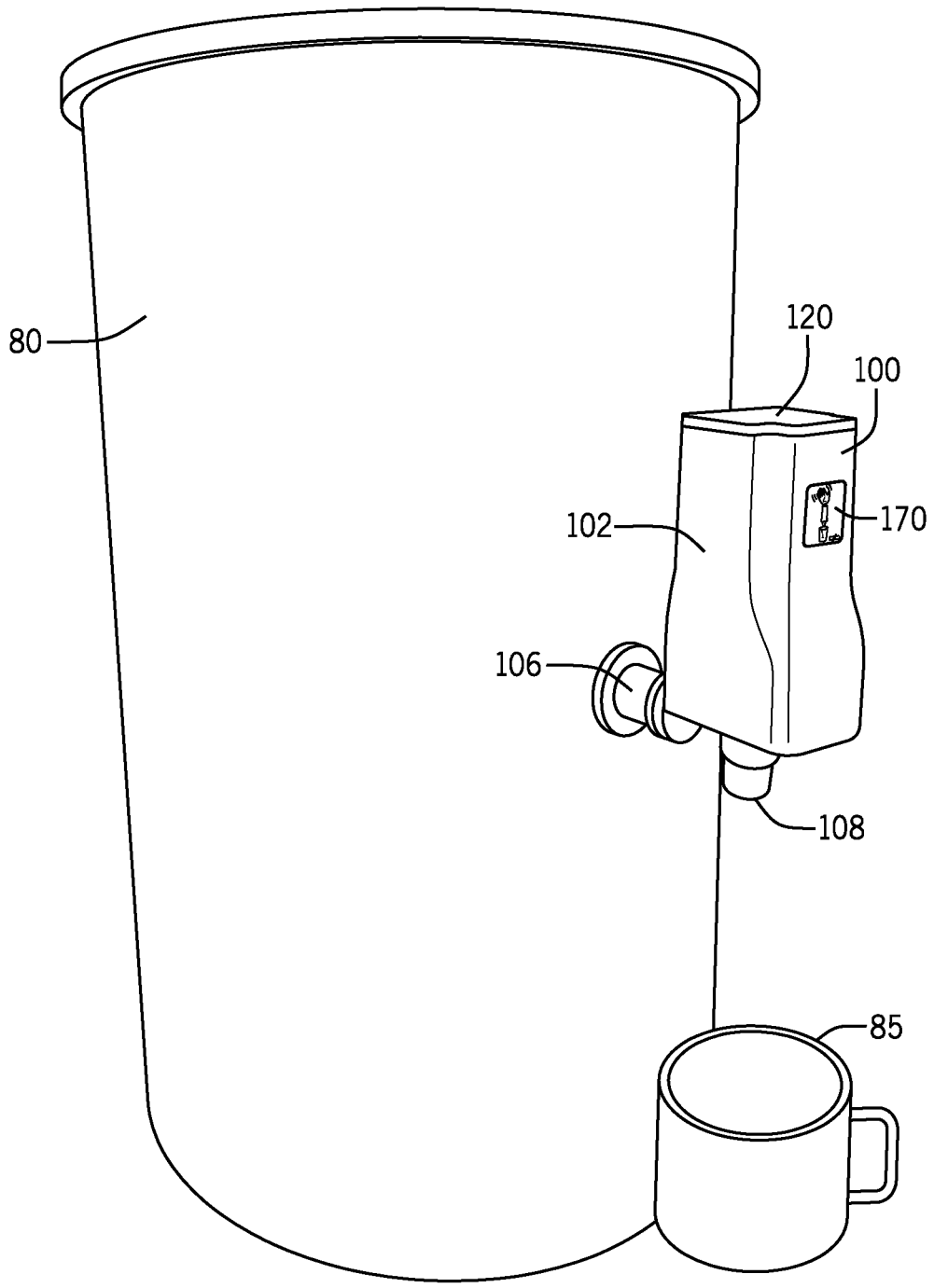
FIG. 5 is a perspective view of the contactless valve of FIG. 4 secured to a container and configured to dispense liquid into a cup.

In some embodiments, a motion sensor can be configured to detect a beverage vessel as it moves through, or is present in, the lower detection zone. For example, as illustrated in FIG. 5, the valve 100 can be secured to a beverage container and the motion sensor 160 can be a cup sensor configured to detect a beverage vessel 85, which may include at least one of a cup, a glass, a mug, a bottle, and any other container configured to hold a liquid. The cup sensor can be configured to distinguish between a beverage vessel and other objects. If movement is detected by the cup sensor 160 but the object moving through the lower detection zone 162 is not identified as a cup, the cup sensor 160 and/or the controller 132 may ignore the movement since the prerequisite condition has not been met. This may be useful, for example, in order to prevent incidental dispensing of a beverage when a cup or other beverage vessel is not properly positioned to receive the beverage. In embodiments in which the contactless valve 100 is secured to a liquid container 80 (see, e.g., FIG. 5), the motion sensor 160 and/or the controller 132 may be configured to ignore the presence of the liquid container 80 or a surface below the outlet 108 if they are detected within the lower detection zone 162.

Once the presence sensor 160 has been activated in response to the detection of a prerequisite condition by an activation sensor 148, the presence sensor can monitor the upper detection zone 152 for the presence of an object. In some embodiments, the presence sensor 160 can be configured to return to the inactive state in an object is not detected in the upper detection zone 152 within a search time limit. The length of the search time limit may be a predetermined value, or the search time limit may be programmable by the user. If an object is detected in the upper detection zone 152, the presence sensor 160 may communicate the detection to the controller 132 via a control signal. The controller 132 can be configured to then command the actuator 128 via control signal communication to move the plug member 140 into the open position, thereby opening the flow path to allow liquid to be dispensed from the outlet 108.

In some embodiments, the contactless valve 100 can be configured to limit the amount of fluid dispensed by setting a time limit for how long the plug member 140 can remain in the open position. The dispense time limit may be a predetermined length of time, or the dispense time limit may be programmable by the user. After the time limit has been reached, the controller 132 can instruct the actuator 128 to return the plug member 140 to the closed position, thereby resealing the flow path from the inlet 106 to the outlet 108. The presence sensor 160 may then return to the idle state until the prerequisite condition is redetected by an activation sensor 148.

Additionally or alternatively, the contactless valve 100 can be configured to continue to dispense liquid only while the object detected by the presence sensor 160 remains in the upper detection zone 152. In such an embodiment, the controller 132 can be configured to control the actuator 128 to return the plug member 140 to the closed position when the presence sensor 160 is no longer detecting an object in the upper detection zone 152. The presence sensor 160 can be configured to continue to monitor the upper detection zone 152 for a dwell time period after each time the object leaves the upper detection zone 152. The dwell time limit may be a predetermined length of time, or the dwell time limit may be programmable by the user. If an object reenters, the upper detection zone 152 within the dwell time limit, the controller 132 can control the actuator 128 to reopen the valve 100. This may be useful, for example, to allow a user to dispense additional liquid with requiring redetection of the prerequisite condition. The total number of times the valve 100 may be reopened without first deactivation the presence sensor 160 may be limited by a top off limit, which may be a predetermined value or programmable by the user. If no object is detected in the upper detection zone 152 before the dwell time limit expires, or if the top off limit is reached, then the presence sensor 160 may then return to the idle state until the prerequisite condition is redetected by an activation sensor 148.

Figure 2:
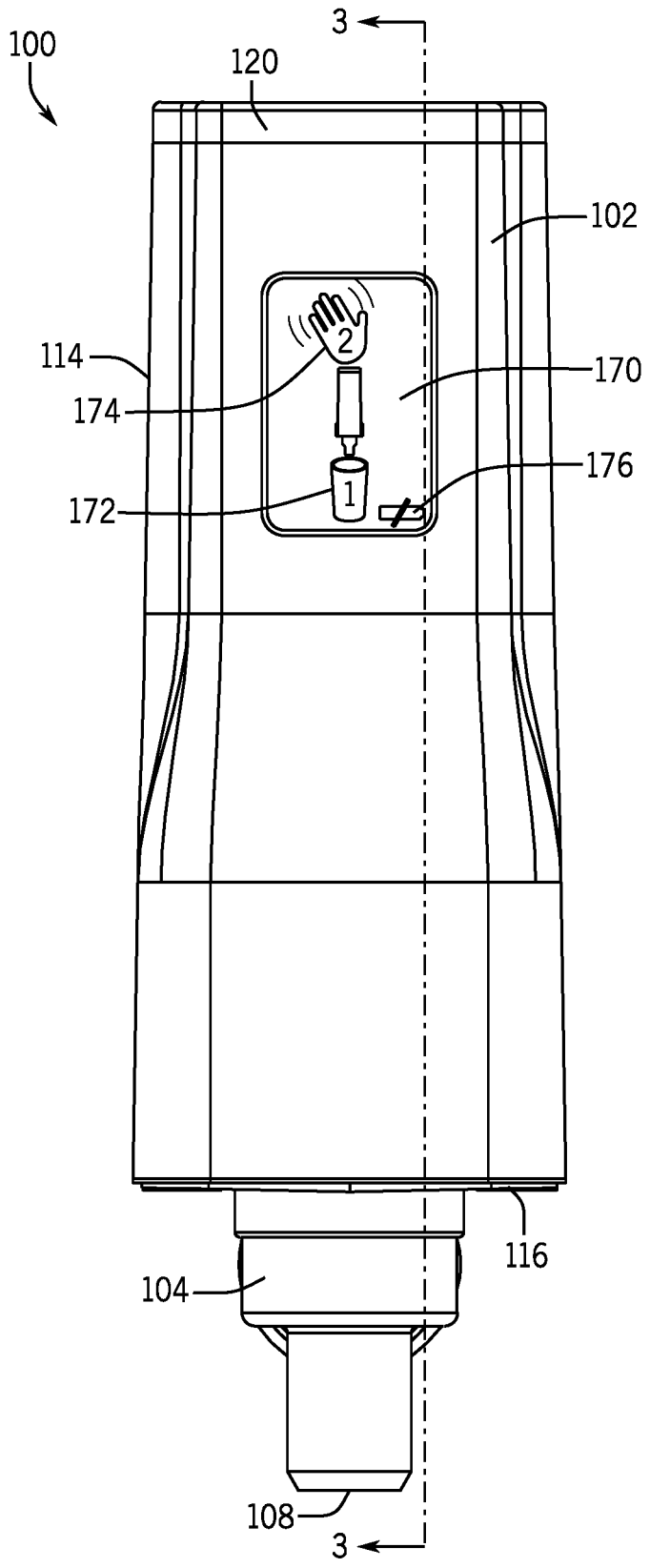
FIG. 2 is a front view of the contactless valve of FIG. 1.

In some embodiments, a contactless valve can include a display configured to provide information regarding the status of the contactless valve. For example, as illustrated in FIG. 2, the contactless valve 100 can include a display 170 positioned on the front side of the housing 102. The display 170 can be in communication with the controller 132, and can include LED lights that may be illuminated to indicate different status conditions. For example, a display 170 can be configured to illuminate an indicator 172 to indicate that the prerequisite condition has been detected, that a detected liquid temperature is within or outside of a temperature limit, and/or that a beverage vessel is detected below the outlet. The display 170 can include an indicator 174 that can be illuminated to indicate that the presence sensor has been activated, or that an object has been detected by the presence sensor 146. Additionally or alternatively, the display 170 can include a low battery indicator 176 that is illuminated when the battery is running low on power, and any other status or condition indication.

As previously mentioned, embodiments of a contactless valve can be used with existing liquid dispensers. For example, as illustrated in FIG. 5, the contactless valve 100 can be used to convert an existing beverage dispenser 80 into a touch free dispenser. The inlet 106 of the valve 100 can be screwed into an opening formed in the side of the beverage dispenser 80 in place of a manual valve. While powered by its internal power source 126, the contactless valve does not require an external connection, and no other changes need to be made to the container 80 for use with the contactless valve 100. Once connected to the container 80, the valve 100 can begin scanning for the conditions needed to dispense a beverage from the container 80 into a mug 85 (or other beverage vessel) positioned below the outlet 108. This can include, for example, at least one of scanning for a prerequisite condition with an activation sensor 148*a*, 148*b*, monitoring a temperature of the beverage to be dispensed with a temperature sensor 158, monitoring for motion or the presence of a beverage vessel 85 below the outlet 108 with a motion sensor 160, monitoring for the presence of an object (e.g., a hand) above the sensor with a presence sensor 146, and any checking for the presence or absence or any other condition.

Figure 6:
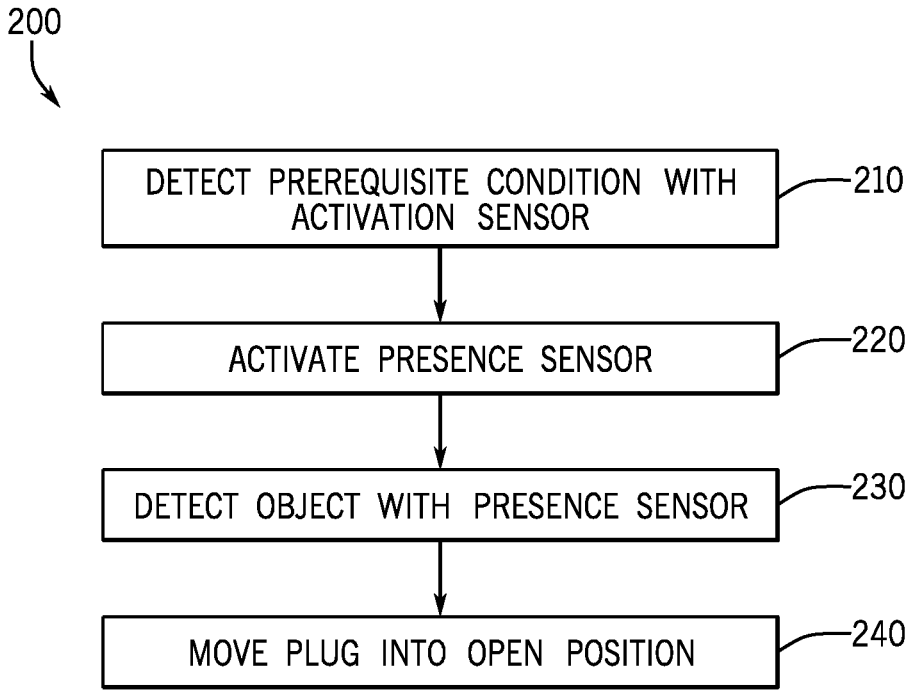
FIG. 6 is a flow diagram illustrating an embodiment of a method for controlling a contactless valve.

Referring now to FIG. 6, a method 200 for controlling a contactless valve to dispense a liquid is illustrated as a flow diagram. In some embodiments, the controller 132 can monitor an activation sensor 148 in the step 210 of detecting a prerequisite condition. In embodiments of a contactless valve 100 including a temperature sensor 158 configured as an activation sensor, detecting a prerequisite condition can include measuring the temperature of the liquid to be dispensed with the temperature sensor 158. Step 210 can also include determining if the measured temperature falls within a temperature limit range to detect the prerequisite condition. For example, the step 210 of detecting a prerequisite condition can include measuring the temperature of the liquid and determining if the measured temperature is below a maximum temperature threshold.

In some embodiments, the method 200 can include steps for illuminating an indicator light on a display 170 if the temperature of the liquid measured by the temperature sensor 158 fall outside of the temperature limit range. Additionally or alternatively, step 210 can include communicating the measured temperature from the temperature sensor 158 to the controller via a control signal, or communicating that the prerequisite condition has been detected from the temperature sensor 158 to the controller via a control signal. If the temperature of the liquid measured by the temperature sensor 158 is within of the temperature limit range, then the prerequisite condition has been detected and the controller can proceed to step 220.

In embodiments of a contactless valve 100 including a motion sensor 160 configured as an activation sensor, detecting a prerequisite condition can include monitoring a lower detection zone 162 for movement with the motion sensor 160. The step 210 of detecting a prerequisite condition can further include communicating, via control signal from the motion sensor 160 to the controller 132, the detection of the prerequisite condition when motion is detected by the motion sensor 160. In some embodiments, the motion sensor can be configured as a cup sensor, and the step 210 of detecting a prerequisite condition can include detecting movement of a beverage vessel in the lower detection zone 162. In some embodiments, this can include determining if the object moving through the lower detection zone 162 is a beverage vessel, and ignoring movement of objects that are not beverage vessels. If, however, the moving object is identified as a beverage vessel by the cup sensor, then the prerequisite condition has been detected.

After the activation sensor 148 (be it a temperature sensor, a motion sensor or any other sensor configured as an activation sensor) has detected the prerequisite condition in step 210, the presence sensor 146 can be activated in step 220. In some embodiments, this can include communicating a control signal from the controller 132 to the presence sensor 146 to switch the presence sensor 146 from an idle state to an active state. In some embodiments, the method 200 can additionally include steps for illuminating an indicator light on a display 170 to indicate that the prerequisite condition has been detected and/or that the presence sensor is in the active state.

Following the activation of the presence sensor 146 in step 220, the presence sensor 160 can be used in the step of detecting an object 310. This can include monitoring an upper detection zone 152 with the presence sensor 160 and communicating the detection of an object in the upper detection zone 152 from the presence sensor 146 to the controller 132 via a control signal. In some embodiments, the presence sensor 160 can be configured as a hand sensor configured to detect the presence of a hand in the upper detection zone 152, and communicating the detection of a hand to the controller 132 via a control signal. Additionally or alternatively, the method 200 can include steps for deactivating the presence sensor 160 if an object is not detected in the upper detection zone 152 within a maximum search time limit.

After the presence sensor 160 has detected the presence of an object in the upper detection zone 152, liquid can be dispensed by moving the plug member 140 into the open position in step 240. In some embodiments, this can include the controller 132 communicating with the actuator 128 to instruct the actuator 128 to move the plug member 140 from a closed position in which liquid is prevented from flowing through the valve body 104 to the open position. Once the plug member 140 is in the open position, liquid can be dispensed by flowing from the inlet 106 to the outlet 108.

In some embodiments, a method 200 for controlling a contactless valve to dispense a liquid can include steps for closing the valve 100 after it has been opened. For example, the method 200 can include steps for returning the plug member 140 to the closed position when if an object is no longer present in the upper detection zone 152. This may include monitoring the object detected by the presence sensor 160 while liquid is being dispensed, and controlling the actuator 128 to return the plug member 140 to the closed position when the object moves out of the upper detection zone 152. Further, some embodiments can include steps for reopening the valve 100 after closing due to the object leaving the upper detection zone 152. For example, the method 200 can include steps for continuing to monitor the upper detection zone 152 with the presence sensor 160 and reopening the valve if an object is redetected in by the presence sensor 160 within a dwell time limit. In some embodiments, the steps for reopening the valve may be repeated indefinitely, while other embodiments can be configured to limit the number of times these steps can be repeated with a top off limit. If no object is redetected in the upper detection zone 152 within the dwell time limit, or if the top off limit is reached, limit, the presence sensor 160 may be switched into the idle state by the controlled pending reactivation upon redetection of the prerequisite condition in step 210.

Additionally or alternatively, a method 200 for controlling a contactless valve to dispense a liquid can include steps for closing the valve 100 after a time limit is reached. In such an embodiment, the method 200 can include steps for monitoring the amount of time since the valve 100 was opened. Once the length of time the valve 100 has been open reaches a dispense time limit, the controller 132 can command the actuator 128 to return the plug member 140 to the closed position, and the presence sensor 160 may be switched into the idle state by the controlled pending reactivation upon redetection of the prerequisite condition in step 210.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A contactless valve configured to dispense a liquid from a fluid source, the contactless valve comprising:

a housing secured to a valve body that defines a flow path from an inlet to an outlet;

an actuator mounted in the housing and configured to move a plug between a closed position in which the plug prevents the flow of liquid through the valve body, and an open position in which the flow of liquid along the flow path is permitted;

an activation sensor positioned within the housing and configured to detect a prerequisite condition;

a presence sensor positioned within the housing and configured to detect the presence of an object in an first detection zone when the presence sensor is in an activated state;

a controller configured to control the actuator and in electrical communication with the activation sensor and the presence sensor; and wherein the controller is configured to switch the presence sensor into the activated state in response to the detection of the prerequisite condition by the activation sensor, and to control the actuator to move the plug from the closed position to the open position in response to the detection of the object in the first detection zone by the presence sensor.

2. The valve of claim 1, wherein the presence sensor is a hand sensor configured to detect the presence of a hand in the first detection zone.

3. The valve of claim 1, wherein the activation sensor is a temperature sensor configured to detect the temperature of the liquid to be dispensed, and the prerequisite condition is a liquid temperature that is within a temperature range.

4. The valve of claim 1, wherein the activation sensor is a motion sensor configured to detect movement in a second detection zone extending outlet, and the prerequisite condition is detection of movement in the second detection zone.

5. The valve of claim 4, wherein the presence sensor is a cup sensor configured to detect the presence of a beverage vessel in the second detection zone.

6. The valve of claim 5, wherein the cup sensor is configured to differentiate between beverage vessels and other objects, and the prerequisite condition is movement of the beverage vessel in the second detection zone.

7. The valve of claim 1, wherein the inlet includes a mounting interface configured to secure the contactless valve to the fluid source.

8. The valve of claim 1, further comprising a power source removably received in a battery compartment within the housing.

9. The valve of claim 8, further comprising a lid configured to seal an opening into the battery compartment when the lid is secured to the housing; and a latch configured to secure the lid to the housing, wherein the latch can be unlocked to remove the lid by hand.

10. The valve of claim 1, further comprising a display positioned on a front side of the housing and in electrical communication with the controller, the display being configured to provide status indications.

11. A method for dispensing a liquid with a contactless valve, the valve including a valve body defining a flow path from an inlet to an outlet and a plug selectively movable between a closed position in which flow through the valve body is restricted, and an open position in which flow through the valve body is permitted, the method comprising steps for:

detecting, with an activation sensor, a prerequisite condition;

activating, with a controller, a presence sensor in response to detection of the prerequisite condition by the activation sensor;

detecting, with the presence sensor, the presence of an object in an first detection zone; and moving, with an actuator, the plug from the closed position to the open position in response to detecting the presence of an object in an first detection zone, thereby dispensing liquid from the outlet.

12. The method of claim 11, wherein the presence sensor is a hand sensor and the step of detecting an object in the first detection zone comprises:

detecting, with the hand sensor, the presence of a hand in the first detection zone.

13. The method of claim 11, further comprising steps of:

deactivating, with the controller, the presence sensor if the object is not detected in the first detection zone within a search time limit.

14. The method of claim 11, wherein the activation sensor is a temperature sensor, and the step of detecting the prerequisite condition comprises:

detecting, with the temperature sensor, a temperature of the liquid to be dispensed that is within a temperature range.

15. The method of claim 11, wherein the activation sensor is a motion sensor, and the step of detecting the prerequisite condition comprises:

detecting, with the motion sensor, movement within a second detection zone.

16. The method of claim 15, wherein the motion sensor is a cup sensor, and the step of detecting the prerequisite condition comprises:

detecting, with the cup sensor, movement of a beverage vessel in the second detection zone.

17. The method of claim 11, further comprising steps of:

monitoring, with the presence sensor, the object in the first detection zone while the liquid is dispensed; and moving, with the actuator, the plug from the open position to the closed position in response to the object moving out of the first detection zone.

18. The method of claim 17, further comprising steps of:

continuing to monitor the presence sensor after moving the plug to the closed position; and moving the plug back into the open position in response to the object moving back into the first detection zone, or deactivating the presence sensor after a dwell time limit has been reached.

19. The method of claim 11, further comprising steps of:

moving, with the actuator, the plug from the open position to the closed position after a dispense time limit has been reached; and deactivating the presence sensor after moving the plug to the closed position.

20. The method of claim 11, further comprising steps of:

illuminating an indicator light on a display in response to the detection of the prerequisite condition by the activation sensor.

* * * * *